United States Patent [19]

Merkel

[11] Patent Number: 5,064,163

[45] Date of Patent: Nov. 12, 1991

[54] CONNECTING DEVICE FOR SHUTTERING PANELS

[75] Inventor: Josef Merkel, Steinach, Fed. Rep. of Germany

[73] Assignee: Josef Maier, Steinach, Fed. Rep. of Germany

[21] Appl. No.: 459,710

[22] PCT Filed: Jul. 16, 1988

[86] PCT No.: PCT/DE88/00440

§ 371 Date: Jan. 29, 1990

§ 102(e) Date: Jan. 29, 1990

[87] PCT Pub. No.: WO89/01083

PCT Pub. Date: Feb. 9, 1989

[30] Foreign Application Priority Data

Jul. 28, 1987 [DE] Fed. Rep. of Germany ..... 3724873

[51] Int. Cl.[5] ..... E04G 17/00

[52] U.S. Cl. ..... 249/47; 249/195; 249/196; 249/219.1

[58] Field of Search ..... 249/195, 192, 196, 194, 249/219.1, 47, 44, 219.2

[56] References Cited

U.S. PATENT DOCUMENTS

| | | | |
|---|---|---|---|
| 2,964,294 | 12/1960 | Imonetti | 249/219.2 |
| 3,363,877 | 1/1968 | Gates | 249/219.2 |
| 3,550,898 | 12/1970 | Ursini | 249/195 |
| 4,188,017 | 2/1980 | Dingler | 249/219.1 |

FOREIGN PATENT DOCUMENTS

| | | | |
|---|---|---|---|
| 617554 | 4/1961 | Canada | 249/194 |
| 1205905 | 2/1960 | France . | |
| 789402 | 9/1955 | United Kingdom | 249/219.1 |

*Primary Examiner*—Jay H. Woo
*Assistant Examiner*—Robert B. Davis
*Attorney, Agent, or Firm*—Peter K. Kontler

[57] ABSTRACT

A form for the pouring of concrete has first and second panels which are disposed edge-to-edge. Each of the panels has a flange projecting from the major surface of the respective panel and the flanges have confronting first surfaces which are perpendicular to the major surfaces of the panels and are designed to abut one another. The flanges have second surfaces which face away from the first surfaces and the second surfaces are inclined to the major surfaces of the panels so that the flanges narrow in a direction away from the panels. A clamping element designed to embrace the flanges is pivotally mounted on the first panel and is movable between a released position and a clamping position in which it embraces the flanges. The second panel carries an abutment and the clamping element has a free end which is located between the abutment and the flange of the second panel in the clamping position. A wedge-like slide is mounted on the free end of the clamping element for movement between a retracted position and an extended position. The arrangement is such that, when the clamping element is in its clamping position and the slide is moved to its extended position, the slide pushes against the abutment thereby causing the clamping element to urge the flanges into engagement with one another.

22 Claims, 4 Drawing Sheets

CONNECTING DEVICE FOR SHUTTERING PANELS

BACKGROUND OF THE INVENTION

The invention concerns a connecting device with a clamp for shuttering panels having edge webs which extend at right angles to the shuttering skin and are gripped round by the clamp in its position of use. The clamp is pivotable about an axis parallel to one of the edge webs into a loose position and a position of use. The clamp can be fastened in its position of use, with a free clamp arm facing away from the pivot bearing, against a rod or the like running parallel to the second edge web and can be clamped in such a way that the two abutting edge webs are pressed together.

A comparable connecting device is known from U.S. Pat. No. 3,550,898. The pivoted clamp is formed in two parts in this case, and the free clamp arm must be guided to shift relative to the pivoted clamp arm and is drawn back into its clamping position. Drawing back takes place by means of a wedge which penetrates elongated slots in the two associated parts of the clamp. The free clamp arm is formed like a hook and grips round a rod or bolt in its position of use. In this way it is true that the edge webs of two shuttering panels are drawn together, but there exists the danger because of the unavoidable play inside the individual parts belonging to this connecting device that they are clamped together offset to one another and graduations arise later in the concrete.

SUMMARY OF THE INVENTION

There therefore exists the task of creating a connecting device of the type mentioned at the beginning with which alignment of the shuttering panels to be connected is achieved. A separate wedge which can possibly get lost should be avoided.

To solve this task, the connecting device of the type mentioned at the beginning is improved in that the clamp, in its position of use, grips the surfaces of the edge webs facing away from each other, at least in part. To clamp the free clamp arm to the rod, an extension piece sliding approximately in the direction of the free clamp arm is provided and grips the rod from below in a clamping manner after sliding. Due to the formfitting closure, alignment of the shuttering is achieved upon clamping and an aligned shuttering panel is held in this position. The sliding extension piece makes a separate clamping wedge superfluous.

Alignment of the shuttering panels can be achieved particularly well and securely if the free edges of the edge webs lie against the inside of the clamp in its position of use. In this way possible slight displacements of the edge webs can still be eliminated by the clamping and fixing of the clamp.

The extension piece can be arranged on a projection of the free clamp arm which can be swung past the rod and is spaced from the rod in its position of use. Thus the clamp arm can be conveniently swung past the rod into its position of use with the extension piece pulled back or, after pulling back the extension piece, it can be brought into its loose position. In the position of use, fixing and clamping can take place in a simple manner by pushing out the extension piece. In this case it is particularly expedient if the upper side of the sliding extension piece facing the rod runs obliquely to the sliding direction and the side of the rod gripped from below such that the upper side is upwardly inclined in a direction opposite to the sliding direction. In this way, when the clamp is fixed in its position of use with the aid of the sliding extension piece, a clamping effect is simultaneously achieved because of the mentioned inclination. Subsequent loosening is also made easier.

A simple design results if the extension piece can slide on a support running approximately parallel to the underside of the rod and is formed as a wedge. In this way the desired wedging and clamping results upon the mentioned sliding of the extension piece into its clamping position, which is also sufficient for fixation and can generate the desired clamping forces quickly and simply. In this way the fastening and clamping wedge—in addition to being guided at the underside thereof facing away from the rod—can be guided by means of a cross pin or the like, so as not to be lost, in an elongated slot. Further, the clamp can be pivoted on the firmly installed pivot axis in such a manner that it cannot be lost. The entire fastening device is then connected in an advantageous way with the respective shuttering panel and remains to a certain extent integrated in the shuttering.

A particularly favourable transmission of force results if the free clamp arm can be swung into its position of use with the extension piece between the edge web and the anchoring rod. If the extension piece is then pushed in and wedged between the free clamp arm and the rod of the extension piece, there results the desired pressure against the edge web to be held.

To enable the extension piece to be slid simply and yet effectively, the latter can have a projection, at the end thereof facing away from the fastening end, which extends beyond the guide and the clamp arm for engagement by a tool, in particular a hammer. This not only facilitates striking of the extension piece into its position of use but also loosening of the same. The underside of this projection can be struck or the projection can be pulled.

The internal contour of the clamp can largely correspond to the external contour of the two adjacent edge webs. The free clamp arm expediently has a projection pointing to the inside of the clamp and abutting the edge web on the rod side as a stop. The clamp arm does not necessarily bear over its entire length against this edge web on the rod side, so that certain dimensional differences, tolerances and clamping distances can be compensated for and the end of the clamp arm can be brought with certainty into engagement with the corresponding edge web since the mentioned projection is expediently provided at the end of the clamp arm. To produce a certain movement of the two edge webs towards one another by swinging the clamp into its position of use, the upper sides of the two edge webs facing away from their contact surfaces can be inclined in cross section from the shuttering skin to their free edges. The two edge webs together can approximate a trapezium and the clamp opening can accordingly be essentially trapezoidal.

In order to achieve effective location of the clamp against the edge web on the pivot side of the shuttering panel provided with the clamp, the bearing eye of the pivot bearing of the clamp can be eccentric and spaced from the neighbouring edge web by about twice the eccentricity in the open position while the inside of the clamp is pressed against the edge web in the closed position. In this way the force to be transmitted by the clamp onto the edge web of the other shuttering panel is not transmitted exclusively through the bearing but also through the edge web on the bearing side.

The rod for anchoring the clamp in its position of use can have a plane underside in cross-section for location of the extension and can be formed as a square tube or the like. The underside can be oriented approximately parallel to the sliding direction of the extension piece. In this way the sliding direction of the extension piece can make a smaller acute angle with a perpendicular to the shuttering skin than the free clamp arm and its inside which can be placed against the edge web. Thus, by pushing out the extension piece, not only can a clamping effect be achieved but also a certain formfitting closure in the position of use, because the extension piece grips beneath the rod so that swinging up is no longer possible. A locking effect is therefore achieved and the extension piece acts not only as a clamping element but also a safety catch.

It should still be mentioned that the pivot axis for the clamp, and preferably the fastening rod, runs between webs of the shuttering boards arranged at right angles to the edge webs to be connected and/or is anchored to these webs. A special housing or bearings are then not required but bracing webs of the shuttering panels can be used for anchoring the entire fastening device. A combination of a mirror symmetrical arrangement and design of the pivot axes and rods with the possibility of being able to dismantle the clamp, despite the fact that it cannot be lost, because of a lockable gap in the opening for the pivot axis permits a rod forming the pivot axis in one application to be used as a fastening rod for the sliding extension piece in another application. Furthermore, the clamp can be pivotally connected to the rod previously serving to anchor the extension piece. In this way clamps and shuttering boards can be combined practically arbitrarily and when connecting the shuttering boards it is not necessary to pay strict attention in order to insure that, in the connecting area, a pivot axis is located on one side and a fastening rod on the other side.

The arrangement of such pivot axes or rods along the shorter narrow sides and edges of the shuttering boards permits arbitrary arrangement of shuttering boards rotated by 90° in combination with shuttering boards not rotated in this manner. For example, shuttering walls, which are formed by shuttering panels arranged with the longer edges vertical, can be increased in height, because shuttering boards rotated by 90° can be placed on the upper edges of the upright shuttering boards and can be fixed with the clamp.

Different embodiments of the invention are described below in greater detail with reference to the drawings.

DESCRIPTION OF PREFERRED EMBODIMENTS

Figure 1:
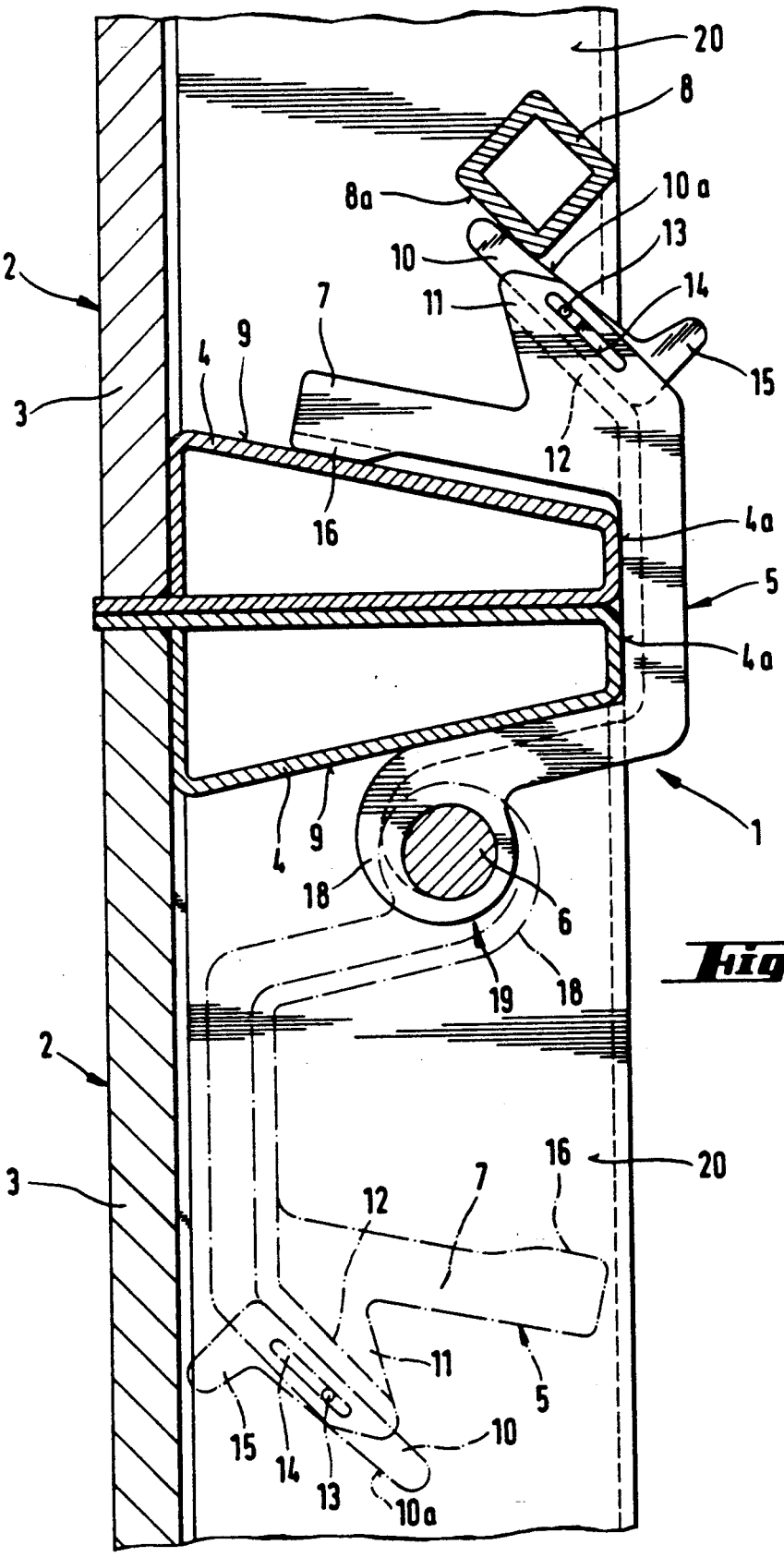
FIG. 1 is a partly sectional top view of the fastening device with a front view of the edge webs to be connected.

In FIG. 1, a connecting device for neighboring shuttering panels 2 is designated generally by 1. The shuttering panels 2 have edge webs 4 extending at right angles to the shuttering skin 3. The connecting device 7 includes a clamp 5 which, in the position of use shown by continuous lines, grips the two edge webs 4 of the neighboring shuttering panels 2 to be connected in alignment with one another.

The clamp 5 is pivotable about an axis 6 parallel to the adjacent edge web 4 into a loose position shown by dot-dash lines and can be pivoted in reverse from this loose position into a position of use.

In the position of use, the free clamp arm 7 of the clamp 5 facing away from the pivot bearing and the pivot shaft 6 can be fastened to a rod 8 running parallel to the second edge web in a way still to be described and can be clamped in such a way that the two edge webs 4 lying against one another are pressed together in the manner shown.

To be able to hold the two shuttering boards 2 together in an aligned position and where necessary to align them further on clamping, the clamp 5, in its position of use, grips at least parts of the surfaces 9 of the edge webs 4 facing away from one another in a formfitting manner. Further, in the position of use, the free edges **4*a* of the edge webs 4 lie against the corresponding inside surfaces of the clamp for good alignment. To clamp the free clamp arm 7 against the rod 8, an extension piece 10 sliding approximately in the direction of the free clamp end is provided and, after sliding, grips beneath the rod 8—as shown in the drawing—to clamp it. FIG. 1 clearly shows that, in this position of the extension piece 10**, swinging back of the clamp is prevented, i.e., is not possible.

The extension piece 10 is arranged on a projection 11 on the outside of the free clamp arm 7. The projection 11 can be swung past the rod 8 and, in the position of use, is spaced from the rod 8 by a gap which is bridged by the extension piece 10. In the illustrated embodiment, the free clamp arm 7 can be pivoted into the position of use between the edge web 4 and the anchoring rod 8, i.e. it is not swung over the side of the rod 8 facing away from the edge web 4 and hooked in there.

The upper side **10*a* of the sliding extension piece 10 facing the rod 8 runs obliquely to the sliding direction and guide. The upper side 10*a* is upwardly inclined in a direction opposite to that in which the extension piece 10 is slid to reach the locking position shown in FIG. 1. Thus after initial contact of this upper side 10*a* with the corresponding underside 8*a* of the rod 8, further pushing of the extension piece 10 results in clamping and pressing of the clamp 5 against both edge webs 4** in the desired manner.

A connecting device designated in total with 1 for shuttering panels 2, which have edge webs 4 standing at their edges at right angles to the shuttering skin 3, covers above all a clamp 5, which in its position in use shown with continuous lines, grips round the two edge webs 4 of shuttering panels 2 to be connected in alignment with one another.

The clamp 5 in this case can be pivoted about an axis 6 parallel to the adjacent edge web 4 into a loose position displayed with dot-dash lines and can be pivoted in reverse from this loose position into its position in use.

In its position in use, the clamp 5 can be fastened with its free clamp arm 7 facing away from the pivot bearing and the pivot shaft 6 against a rod 8 running parallel to the second edge web in a way still to be described and can be clamped in such a way that the two edge webs 4 lying against one another are pressed together in the manner displayed.

To be able to hold the two shuttering boards 2 together in an aligned position and where necessary to align them further on clamping, the clamp 5 in its position in use grips round at least regionally with form closure the surfaces 9 of the edge webs 4 facing away from one another. Further, in this position in use, the free edges 4*a* of the edge webs 4 lie against the corresponding inside of the clamp for a good alignment. To clamp the free clamp arm 7 against the rod 8, an extension piece 10 sliding approximately in the direction of the free clamp end is provided, which after sliding grips beneath the rod 8—as shown in the drawing—to clamp it. One recognizes by reference to the FIG. 1 and 2 clearly that in this position, the extension piece 10, swinging back of the clamp 5 is blocked and is therefore not possible.

The extension piece 10 is arranged in this case on a projection 11 on the outside of the free clamp arm 7 and this projection 11 can be swung past the rod 8 and also in the position in use has a distance to the rod 8 which bridges over the extension piece 10. In the version shown, here the free clamp arm 7 can be swung-in between the edge web 4 and the anchoring rod 8 into its position in use, i.e., it is not swung over the side of the rod 8 facing away from the edge web 4 and hooked in there.

The sliding extension piece 10 runs with its upper side 10*a* facing the rod 8 obliquely to its sliding direction and guide, whereby this inclination rises in opposition to the direction in which the extension piece 10 is slid to reach the locking position shown in the Figure. Thus after a first touching contact of this upper side 10*a* with the corresponding underside 8*a* of the rod 8 there results when the extension piece 10 is pushed further clamping and pressing of the clamp 5 against both edge webs 4 in the desired manner.

To be able to transfer sufficiently large forces, the extension piece 10 can be slid on a support 12 shown dashed and running approximately parallel to the underside 8*a* of the rod. Due to the inclination of the upper side 10*a*, the extension piece 10 is, practically speaking, in the form of a wedge. In addition to being guided by the support 12, the extension piece can be guided at the outside of the clamp, by means of a cross pin 13, in an elongated slot 14 of a flange, a grooved wall or the like so as to prevent loss thereof. This is clearly seen in the illustrated embodiment.

In the illustrated embodiment, the extension piece 10 has, at its end facing away from the fastening end, a projection 15 for engagement by a tool, e.g. a hammer. The projection 15 extends beyond the guide 12 and the clamp arm 7 or projection 11. The extension piece 10 can be hammered into its position of use with the tool or loosened by hammering in the opposite direction against the projection 15. In practice there thus results an extension piece 10 which acts and can be used like a push and pull catch and, in addition, has the already described wedge effect.

It has already been mentioned that the internal contour of the clamp 5 largely corresponds to the external contour of the two edge webs 4 lying against one another. In the illustrated embodiment, the free clamp arm 7 has, close to its free end, a stop projection 16 directed towards the inside of the clamp as a stop against the edge web on the rod side. The remaining upper side 9 of this edge web 4 therefore remains free, so that dimensional differences and tolerances do not have negative effects. Rather, the clamp regions spaced furthest apart come into contact with the upper sides 9 of the respective edge webs 4 and produce the desired clamping and connection with the best possible lever action. As seen in cross section, the upper sides 9 of the two edge webs 4 facing away from their contact surfaces are inclined from the shuttering skin 2 to the free edges 4*a* and together approximate a trapezium; accordingly the clamp opening is also essentially trapezoidal. Thus even if the edge webs 4 are still somewhat apart, the clamp 5 can be swung into its position of use thereby bringing the two edge webs 4 closer to one another and aligning them.

In order that the clamp 5 can swing completely freely when open but can also be brought firmly into contact against the edge web 4 on the bearing side when closed, the bearing eye 18 of the pivot bearing 19 is eccentric. In the open position of the clamp 5 shown by dot-dash lines, the bearing eye 18 is spaced from the neighbouring edge web 4 by a distance approximately equal to double the eccentricity, whereas it is pressed against the edge web 4 in the closed position by the inside of the clamp.

The rod 8 has an underside 8*a* which is flat in cross-section for good location of the extension piece 10 and, in the illustrated embodiment, is in the form of a square tube. As seen in cross-section, the underside 8*a* is oriented approximately parallel to the sliding direction of the extension piece 10. From the orientation of the elongated slot 14 and the guide support 12, it can be observed that the sliding direction of the extension piece 10 makes a smaller acute angle with a perpendicular to the shuttering skin 3 than the free clamp arm 7 and its inside which can be placed against the edge web 4. This not only permits the clamp arm 7 to exert clamping pressure against the edge web 4 engaged thereby but results, in the illustrated position of use, in locking of the clamp 5 against undesired opening.

The pivot shaft 6 for the clamp 5 and also the fastening rod 8 can run between and be anchored to webs 20 of the respective shuttering panels 2 which extend at right angles to the edge webs 4 to be connected. There thus results a fastening device which cannot be lost. If the webs 20 are spaced by relatively large distances, several clamps 5 can be spaced along a shaft 6.

Operation of this fastening device 1 is extremely simple, because after the two shuttering panels 2 are placed together, it is only necessary to pivot the clamp or clamps 5 into the closed position and to anchor the latter by sliding the extension piece 10 in order to connect the two shuttering panels 2 with a large force. Opening of the device and removal of the shuttering is just as simple.

Another embodiment of the clamp 5 and the fastening rod 8 is shown in FIGS. 2 to 5 where parts corresponding to those of FIG. 1 are identified by the same reference numerals.

In this embodiment, the clamp 5 has an opening 19*a* for its pivot shaft 6 and pivot bearing 19. The edge of the opening 19*a* has an at least partially closable gap 21 of length corresponding to the cross-section of the pivot shaft 6. When the gap 21 is opened, the clamp 5 can be removed from the pivot shaft 6 by moving the clamp 5 away from the pivot shaft 6 while the gap 21 extends transversely of the pivot shaft 6.

Figure 2:
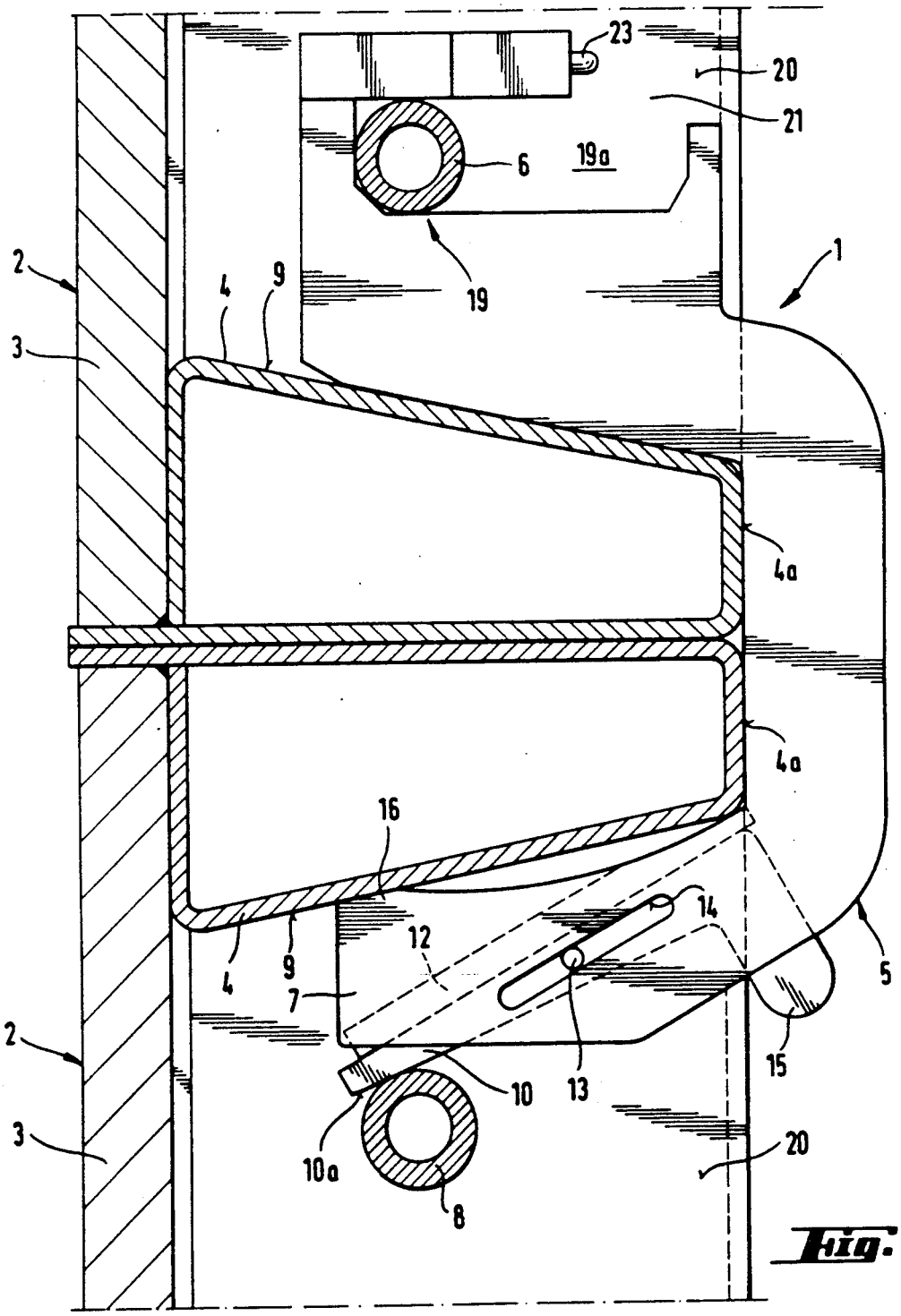
FIG. 2 is an enlarged view similar to FIG. 1 of another embodiment.
Figure 3:
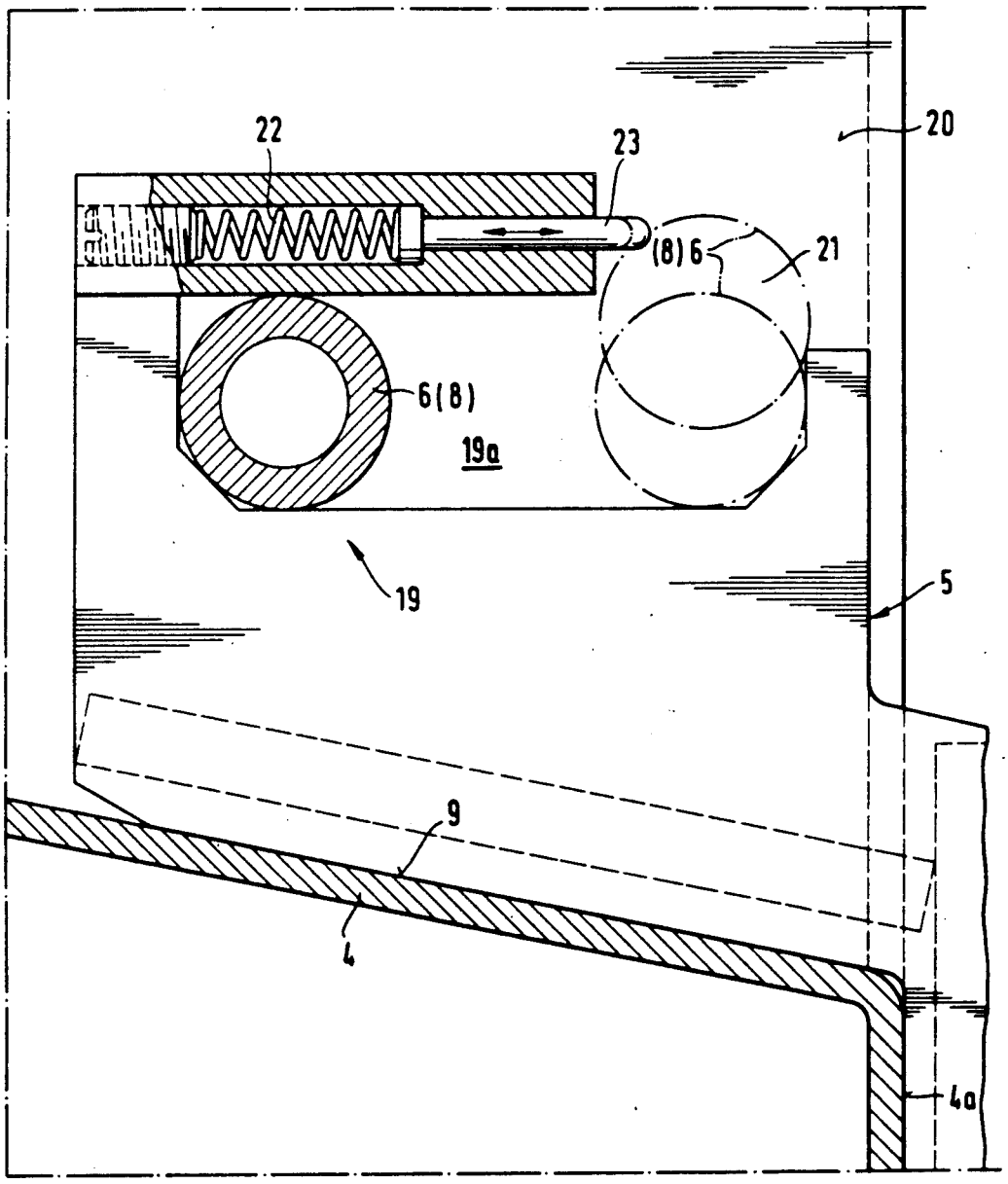
FIG. 3 is a partly sectional view of the clamp of FIG. 2.

The opening 19*a* for the pivot shaft 6 is here an elongated hole running, in the position of use of the clamp 5, transversely to the shuttering skin 3. In the illustrated embodiment, the elongated hole constituting the opening 19*a* extends approximately at right angles to the shuttering skin 3. The gap 21 in the edge of this elongated hole is located close to the end of this elongated hole facing away from the shuttering skin 3. It is seen in FIGS. 2 and 3 that the gap is arranged in the region of the longitudinal wall of the elongated hole, on the side facing away from the clamp, and not directly at its end. Thus, after it is opened, the clamp can easily be moved away from the shuttering panel 2 at the rear of the shuttering panel 2, whereby the pivot shaft 6 is released via the gap 21.

The closure for the gap 21 is formed, in the illustrated embodiment by a pin 23 which can be pushed in against the return force of a return spring 22. However, a spring-loaded bow could also bridge over the gap similarly to an eye on a jewelry clasp or a wall region resiliently biased transversely to the gap similarly to a spring hook could be provided. However, since the closure does not have to bridge over the entire gap 21, a pin 23 projecting into the gap 21 and which can be pushed back from it is sufficient.

In the illustrated embodiment, the pivot shaft 6 and the fastening rod 8 to be gripped by the sliding extension or locking piece 10 are arranged at the same height and the same distance from the edge webs 4 of the shuttering panels 2 to be connected. They have similar cross sections which are here shown as being circular so that the pivot shaft 6 and the rod 8 of two shuttering boards connected with the clamp 5 are arranged mirror symmetrically about a plane running through the joint between their edge webs 4. Since the clamp 5 can be dismantled by virtue of the previously described openable gap 21 despite being mounted such that it cannot be lost as a rule, the pivot shaft 6 and fastening rod 8 can be used interchangeably. Whereas in the embodiment of FIG. 1 the shuttering boards must be joined so that a pivot shaft is available on one side of the joint and a fastening rod is available on the opposite side, this is no longer necessary in the present embodiment.

Figure 4:
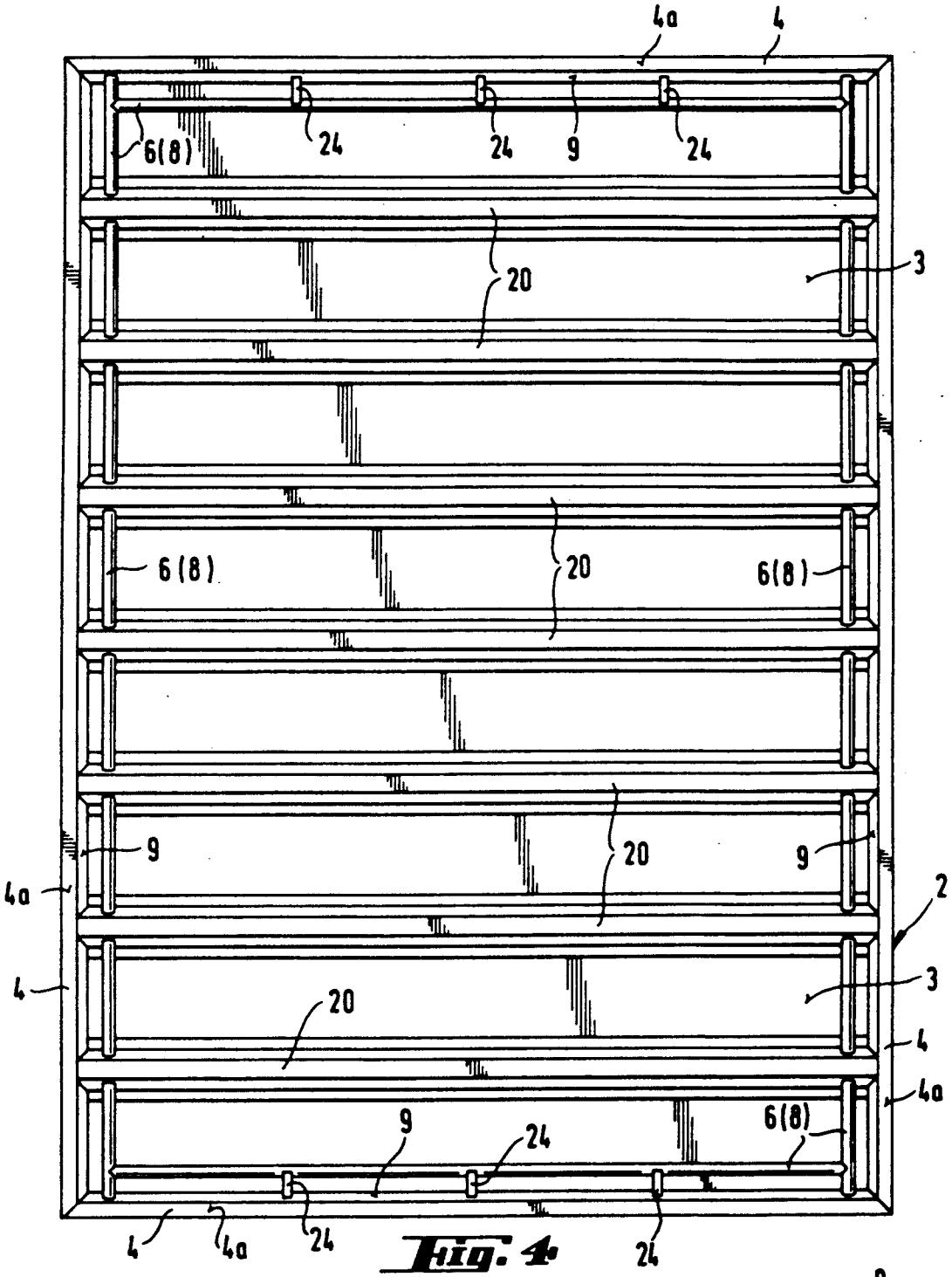
FIG. 4 is a rear view of a shuttering panel having fastening rods and/or pivot shafts inside the edge webs on all four sides.
Figure 5:
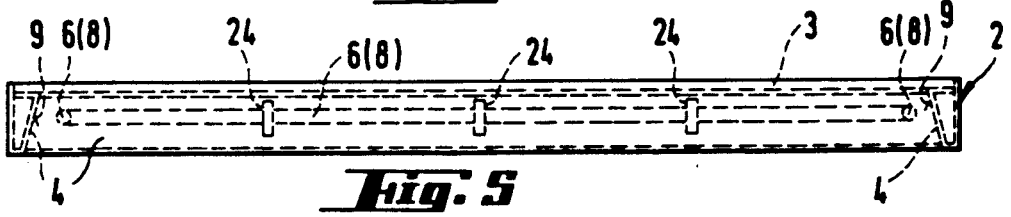
FIG. 5 is a top view of the shuttering panel of FIG. 4.

It is seen in FIG. 4 that pivot shafts 6 and/or rods 8 are provided along all four edge webs 4 of a rectangular shuttering panel 2 at the same distance from the edge webs 4. Thus, to increase the height of a shuttering wall made from shuttering panels 2 whose longer edges extend vertically, a shuttering panel which is rotated by 90° relative to the vertical shuttering panels can be fastened to the latter such that the longer side of the rotated shuttering panel rests on the shorter sides of the vertical shuttering panels. A connection by means of a clamp can be made in this case also.

Naturally these shuttering boards permit mutual height offset, because the clamps can engage the pivot shafts 6 and fastening rods 8 anywhere along the shafts 6 and rods 8.

It is further seen in FIG. 4 that the pivot shafts 6 and rods 8 running parallel to the shorter edges and edge webs of the rectangular shuttering panel 2 are perpendicular to, and butt flush against, the pivot shafts 6 and rods 8 running parallel to the longitudinal sides of the shuttering panel 2. The mutually perpendicular pivot shafts 6 and rods 8 are preferably connected, e.g. welded, to one another. There thus results additional bracing of the entire shuttering panel 2, so that the forces exerted on the clamps 5 can be absorbed and conducted into the bracings and webs of the shuttering panels 2. FIG. 4 further shows that the pivot shafts 6 and rods 8 are arranged between bracing ribs 20 of the shuttering board 2 and may pass through the bracing ribs 20 transversely to their elongation. FIG. 4 also shows that the rods 8 and pivot shafts 6 running parallel to such bracing ribs 20 and parallel to the shorter edges of a shuttering board 2 are connected to the edge webs 4 by at least one support 24 and, in the illustrated embodiment, by three supports 24. These pivot shafts 6 and rods 8 could likewise be connected to the bracing ribs 20 by-one or more supports but, as seen in FIG. 4, the latter supports would have to be longer than the supports 24.

Overall, the invention provides a shuttering panel 2 which can be connected to a neighbouring shuttering panel at any edge and with a variable height offset. The shuttering panel 2 is braced by rods and shafts, and the rods and shafts are engaged by anchoring clamps 5 which are simple to operate and easy to lock. The anchoring clamp 5 of FIGS. 2 and 3 is also interchangeable, despite the fact that its holder cannot be lost, so that the installation of the shuttering panels is simplified.

I claim:

1. A pouring form, comprising a first panel having a first flange which is located at an edge of said first panel and is at least approximately perpendicular to a major surface of said first panel; a second panel having a second flange which is located at an edge of said second panel and is at lest approximately perpendicular to a major surface of said second panel, said flanges abutting one another; and a connecting device for holding said flanges in abutment, said device including a clamping member designed to at least partially embrace said flanges, and said clamping member having first and second surface portions which are respectively in surface-to-surface contact with oppositely facing sides of said flanges when said flanges are embraced by said clamping member, said device further including means mounting said clamping member for pivotal movement between a clamping position in which said clamping member embraces said flanges and a released position in which said flanges are released from said clamping member, and said mounting means defining a pivot axis which is disposed to a first side of, and is substantially parallel to, said flanges, said device additionally including an elongated abutment disposed to a second side of, and being substantially parallel to, said flanges, and said clamping member including an arm which is located on said second side of said flanges in said clamping position and has a free end, said device also including a locking element mounted on said arm for sliding movement along a path extending generally towards and away from said free end, and said locking element being movable between a retracted position and an extended position in which said locking element constitutes an extension of said arm, said locking element being wedged against said abutment when said clamping member is in said clamping position and said locking element is in said extended position.

2. The form of claim 1, wherein each of said flanges has an end face remote from the major surface of the respective panel and said clamping member has a third surface portion which bears against said end faces in said clamping position.

3. The form of claim 1, wherein said arm has a protuberance which is spaced from said abutment in said clamping position, said locking element being mounted on said protuberance.

4. The form of claim 1, wherein said locking element and said abutment have respective first and second bearing surfaces which cooperate to wedge said locking element against said abutment, said first surface being included with respect to said second surface and said path.

5. The form of claim 1, wherein said arm is provided with a support for said locking element and said abutment has a bearing surface which cooperates with said locking element to wedge said locking element against said abutment, said support being substantially parallel to said surface in said clamping position, and said locking element being slidable along said support and being wedge-shaped.

6. The form of claim 1, wherein said arm is provided with an elongated cutout and said locking element has a projection which is received in said cutout and holds said locking element on said arm.

7. The form of claim 1, wherein said abutment defines a gap with one of said flanges and said arm is movable into said gap upon pivoting of said clamping member from said released position to said clamping position.

8. The form of claim 1, wherein said locking element has a trailing end as considered in a direction from said retracted position towards said extended position and said trailing end is provided with a projection for engagement by a tool.

9. The form of claim 1, wherein said clamping member has an opening which receives at least part of said flanges in said clamping position, said opening having an internal contour which at least approximates the external contour of said part, and said arm being provided with an inwardly directed protrusion having one of said surface portions.

10. The form of claim 9, wherein said internal contour is substantially trapezoidal.

11. The form of claim 1, wherein said mounting means comprises a pivot and an eccentric boss which receives said pivot, said boss being spaced from one of said flanges in said released position by approximately twice the eccentricity of said boss and being urged against said one flange in said clamping position.

12. The form of claim 1, wherein said abutment has a substantially flat bearing surface which is essentially parallel to said path and cooperates with said locking element to wedge said locking element against said abutment.

13. The form of claim 1, wherein said arm is provided with one of said surface portions, said arm and said one surface portion making a first acute angle with a normal to the major surface of the associated panel in said clamping position, and said path making a second acute angle with such normal in said clamping position, said second angle being greater than said first angle.

14. The form of claim 1, wherein each of said panels has a pair of spaced ribs which are substantially perpendicular to the respective flange, said mounting means including a pivot, and at least one of said pivot and said abutment being located between the ribs of a panel or being anchored to such a rib.

15. The form of claim 1, wherein said mounting means comprises a pivot and means for preventing disengagement of said clamping member from said pivot.

16. The form of claim 1, wherein said mounting means comprises a pivot having a predetermined diameter and said clamping member is provided with an aperture which receives said pivot, said clamping member including a border which at least partially bounds said aperture and has a gap for insertion of said pivot in and removal of said pivot from said aperture, and said gap having a width at least equal to said predetermined diameter, said device further comprising means for at least partially blocking said gap.

17. The device of claim 16, wherein said aperture is elongated and extends transverse to the major surface of the associated panel in said clamping position, said aperture having first and second ends which are respectively located nearer to and farther from such major surface in said clamping position, and said gap being disposed in the region of said second end.

18. The device of claim 16, wherein said blocking means comprises a blocking element movable between a first position in which said blocking element prevents withdrawal of said pivot from said aperture and a second position in which said blocking element permits withdrawal of said pivot from said aperture; and further comprising means for biasing said blocking element towards said first position.

19. The form of claim 1, wherein said flanges contact each other in a predetermined plane, said mounting means comprising a pivot, and said pivot and said abutment having substantially identical cross sections and being mirror symmetrical to one another about said predetermined plane.

20. The form of claim 1, wherein said panels are rectangular and said mounting means comprises a pivot which extends along a selected side of one panel at a predetermined distance from the selected side, said abutment extending along a preselected side of the other panel at said predetermined distance from the preselected side; and further comprising additional pivots or abutments which are arranged so that at least one pivot or abutment extends along each side of said panels at said predetermined distance from the respective side.

21. The form of claim 20, wherein the pivots or abutments extending along the shorter sides of each panel abut flush against, or are connected to, the pivots or abutments extending along the longer sides of the respective panel.

22. The form of claim 20, wherein each panel has a plurality of spaced ribs extending substantially parallel to the shorter sides of the respective panel and the pivots or abutments extending along the longer sides of the respective panel are disposed between the ribs or pass through the same, each panel being provided with a flange at both shorter edges thereof; and further comprising at least one supporting element for each of the pivots or abutments extending along the shorter sides of said panels, each of said supporting elements connecting the respective pivot or abutment to one of the ribs or one of said flanges at the short edges of said panels.

* * * * *